US005400124A

United States Patent [19]

Kass et al.

[11] Patent Number: 5,400,124

[45] Date of Patent: Mar. 21, 1995

[54] DEVELOPMENT STATION HAVING A ROUGHENED TONING SHELL

[75] Inventors: Allen Kass, Pittsford; Arthur S. Kroll, Fairport; Jerry E. Livadas, Webster; Susan P. Westbrook, Rochester; John M. Beres, Hilton, all of N.Y.

[73] Assignee: Eastman Kodak Company, Rochester, N.Y.

[21] Appl. No.: 976,598

[22] Filed: Nov. 16, 1992

[51] Int. Cl.[6] ..... G03G 15/09

[52] U.S. Cl. ..... 355/251; 118/657; 355/259

[58] Field of Search ..... 355/245, 251, 246, 253, 355/259; 118/657, 658, 661, 656; 492/36, 37

[56] References Cited

U.S. PATENT DOCUMENTS

| | | | |
|---|---|---|---|
| 3,893,815 | 7/1975 | Drummond, Jr. | 492/37 |
| 3,921,580 | 11/1975 | Kase | 355/259 |
| 4,235,549 | 11/1980 | Eisbein et al. | 118/657 |
| 4,395,110 | 7/1983 | Hosono et al. | 355/259 |
| 4,473,029 | 9/1984 | Fritz et al. | 118/657 |
| 4,531,832 | 7/1985 | Kroll et al. | 355/246 X |
| 4,546,060 | 10/1985 | Miskinis et al. | 430/108 |
| 4,564,285 | 1/1986 | Yasuda et al. | 355/259 X |
| 4,671,207 | 6/1987 | Hilbert | 118/657 |
| 4,989,044 | 1/1991 | Nishimura et al. | 355/251 |
| 5,083,166 | 1/1992 | Hill et al. | 355/260 |
| 5,111,245 | 5/1992 | DeCecca et al. | 355/245 |

FOREIGN PATENT DOCUMENTS

| | | | |
|---|---|---|---|
| 57-64764 | 4/1982 | Japan | 355/245 |
| 60-115964 | 6/1985 | Japan | 355/245 |
| 2-73275 | 3/1990 | Japan | 355/245 |
| 2-199479 | 8/1990 | Japan | 355/245 |
| 2-296268 | 12/1990 | Japan | 355/245 |
| 3-12673 | 1/1991 | Japan . | |
| 4-88376 | 3/1992 | Japan | 355/245 |
| 4-243275 | 8/1992 | Japan | 355/245 |
| 4-246676 | 9/1992 | Japan | 355/245 |

*Primary Examiner*—A. T. Grimley
*Assistant Examiner*—Shuk Y. Lee
*Attorney, Agent, or Firm*—Leonard W. Treash

[57] ABSTRACT

A development station for applying toner to an electrostatic image includes a rotatable magnetic core and a roughened sleeve on which developer moves to develop the image. The outside surface of the sleeve contains fine extrusion-formed serrations, which serrations provide a roughness for the outside surface contributing to movement of developer in response to rotation of the magnetic core.

3 Claims, 2 Drawing Sheets

DEVELOPMENT STATION HAVING A ROUGHENED TONING SHELL

This invention relates to the development of electrostatic images and, more particularly, to a type of development of electrostatic images in which developer having a magnetic component is moved along a sleeve or shell by a rotating magnetic core placed within the sleeve or shell.

U.S. Pat. Nos. 4,546,060 to E. T. Miskinis and T. A. Jadwin; 4,473,029 to G. F. Casper, A. S. Kroll and M. Mosehauer; and 4,531,832 to A. S. Kroll and F. A. Schuster, describe a magnetic brush development apparatus providing extremely high quality imaging. In this approach, a magnetic core having magnetic poles which alternate circumferentially around the core is rapidly rotated in close proximity to a development zone. A nonmagnetic sleeve or shell around the core supports a two-component developer of hard magnetic carrier particles having substantial permanent magnetism and insulative toner. The rapid rotation of the core causes rapid pole transitions through the development zone and through portions of the sleeve or shell leading up to the development zone. These pole transitions cause the carrier particles to rotate or "flip" in a direction generally causing them to move around the sleeve or shell in a direction opposite to that of the rotating core. This system is presently being used commercially to provide very high quality images. In some uses of the system, the sleeve is rotatable as well to assist in the movement of the developer. In other embodiments the sleeve is stationary and can have a noncircular cross-section with the entire movement of the developer being provided by the rotating core.

U.S. Pat. No. 5,083,166 to Hill et al shows a low cost development station which uses these principles and has its own supply of toner with the entire development station being replaced when the toner is depleted. This development station shows an irregularly shaped shell surrounding a rotatable magnetic core. The shell is shaped to move hard magnetic carrier through a path which provides a relatively long development zone as well as strong magnetic field strength as the developer moves away from the development zone to avoid pickup of carrier in the magnetic image. This structure has been used commercially in a single-color electrophotographic printer.

U.S. Pat. No. 5,111,245 to DeCecca et al shows a set of four development stations, each of which is similar to the Hill station for use in a color electrophotographic printer. Each of these stations includes an applicator having a rotatable core and shell similar to the Hill applicator, which applicator is movable toward and away from a developer sump for positioning in developing relation with an electrostatic image.

In each of these structures it is desirable to have a roughened outer surface of the sleeve or shell, whether or not the sleeve or shell is rotatable itself. The roughened outer surface contributes to the movement of the developer as the developer flips in response to pole transitions from the rotating core. In the apparatus constructed according to the Hill application, the outer surface of the aluminum shell was roughened by sandblasting.

U.S. Pat. No. 5,162,854, filed in the name of Hilbert et al issued Nov. 10, 1992, discloses a development apparatus having a rotatable magnetic core and a cylindrical sleeve which can be rotatable or stationary. To facilitate movement of developer on the sleeve or shell, the sleeve is roughened by the application of a grit, for example, a size 400 grit. A skive located to remove spent developer from the shell after it has passed through the development zone is also roughened to prevent a backup of developer into the development zone from the point of contact between the skive and the sleeve. This application also shows a fluted roller for delivering developer to the applicator. The fluting on the roller is prepared by a metal extrusion process through a die having flutings of approximately $\frac{1}{4}$ inch in cross-section.

Other references show shells on which developer moves or is moved include, for example, U.S. Pat. Nos. 4,235,549; 4,395,110; 4,564,285.

U.S. Pat. No. 4,564,285 shows a knurled development roller for use with monocomponent developer. The purpose of the knurling is to carry developer that is not moving with respect to the surface.

U.S. Pat. No. 4,671,207 to Hilbert shows a development station generally of the type shown in the Hill and Kroll patents but in which the sleeve is circular in cross-section and is rotatable to assist in the movement of developer. It also shows a fluted supply roller having approximately 25 flutings around its circumference. Again, the fluted supply roller is used to move developer without contemplation of movement by the developer with relation to the fluting.

U.S. Pat. No. 4,989,044 to Nishimura et al shows a developer sleeve having an outer coating layer made of resin material having electrically conductive fine particles. This approach is similar to applying a grit to the surface and results in an irregularly toughened surface.

Both sandblasting and the application of a grit have thus far resulted in a roughened surface which will successfully contribute to the movement of developer in response to a rotating core. However, both approaches provide some irregularity in the surface, which occasionally can cause irregularities in toning. Further, the use of sandblasting has a tendency to weaken the shell and affect its life. If the toning station is replaceable to supply new toner, the life of the shell is not critical. However, in more permanent applications, it would be desirable to have a longer lived shell.

SUMMARY OF THE INVENTION

It is an object of the invention to provide a development station generally of the type described in any of the above references but in which the shell or sleeve has a more regular surface and is not weakening from sandblasting or other such treatments.

This and other objects are accomplished by roughening the surface of the shell or sleeve by providing extrusion-formed serrations in the outside surface of the shell or sleeve.

With this structure, the shell is not weakened by sandblasting and does not have the irregularity of either sandblasting or the application of a grit. Once an appropriate die has been made, the serrations are formed by conventional extrusion process and, thus, are made in the same step that makes the shell itself.

DESCRIPTION OF THE PREFERRED EMBODIMENTS

In the embodiment in the FIGS. a rotating magnetic core is positioned inside a stationary and irregularly shaped sleeve. However, it is understood that the invention is usable with other forms of development apparatus in which a roughened sleeve is desirable, including sleeves having a circular cross-section and which are either stationary or rotatable.

Figure 1:
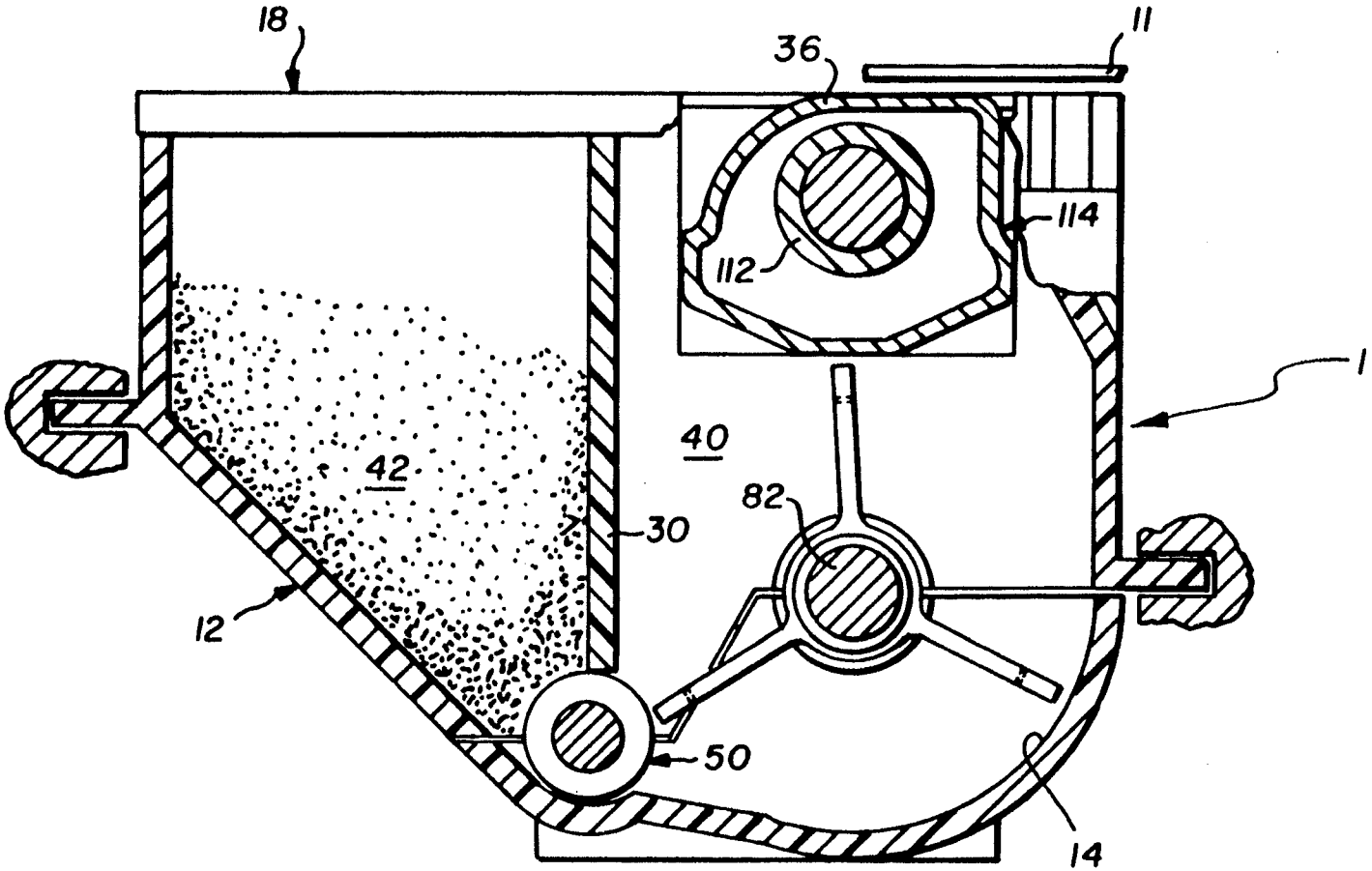
FIGS. 1 and 2 are front sections of alternative embodiments of toning stations in which the invention is usable.

Referring to FIG. 1, a development or toning station 1 is positioned to tone an electrostatic image carried on a moving image member 11. Toning station 1 includes a housing 12 having a center wall 30 which combine to form two side-by-side chambers 40 and 42. Chamber 42 has largely filled with toner, into which may be mixed a small amount of carrier. Chamber 40 includes a developer mix of hard magnetic carrier particles and toner. A supply roller 50 is rotatable to feed toner from chamber 42 into chamber 40 to replace toner lost in the development process.

Chamber 40 includes a sump 14 in which is mounted a mixing device 82. At the top of chamber 40 is an applicator 114 which is made up of a stationary sleeve 36 around a rotatable magnetic core 112. A lid 18 closes the top of the station 1 with applicator 114 protruding through an opening in it.

In operation, rotation of mixing device 82, in addition to mixing and stirring the developer for evenness of distribution and charging of carrier and toner, raises the level of developer in sump 14 until it is attractable by rotatable magnetic core 112. Rotation of core 112 in a clockwise direction causes movement of developer from sump 14 up the right side of sleeve 36 and into a development zone in development relation with an electrostatic image carried by image member 11. The developer moves along a relatively fiat portion of the sleeve 36 going at approximately the same speed and direction as image member 11 to thoroughly develop the image without artifacts caused by relative movement. As the developer reaches the left side of sleeve 36, the sleeve is curved away from the development zone while still in relatively close proximity to rotating core 112. The closeness of core 112 prevents the loss of magnetic carrier particles in the developer to the electrostatic image as the electrostatic image and developer move away from each other. As the developer is moved down the left side of the sleeve, it moves away from the magnetic core and eventually falls back into the sump 14 where it is mixed by mixing device 82 to be replenished with toner and ultimately to repeat the process. For more details with respect to such a toning station, see U.S. Pat. No. 5,083,166, referred to above.

Figure 2:
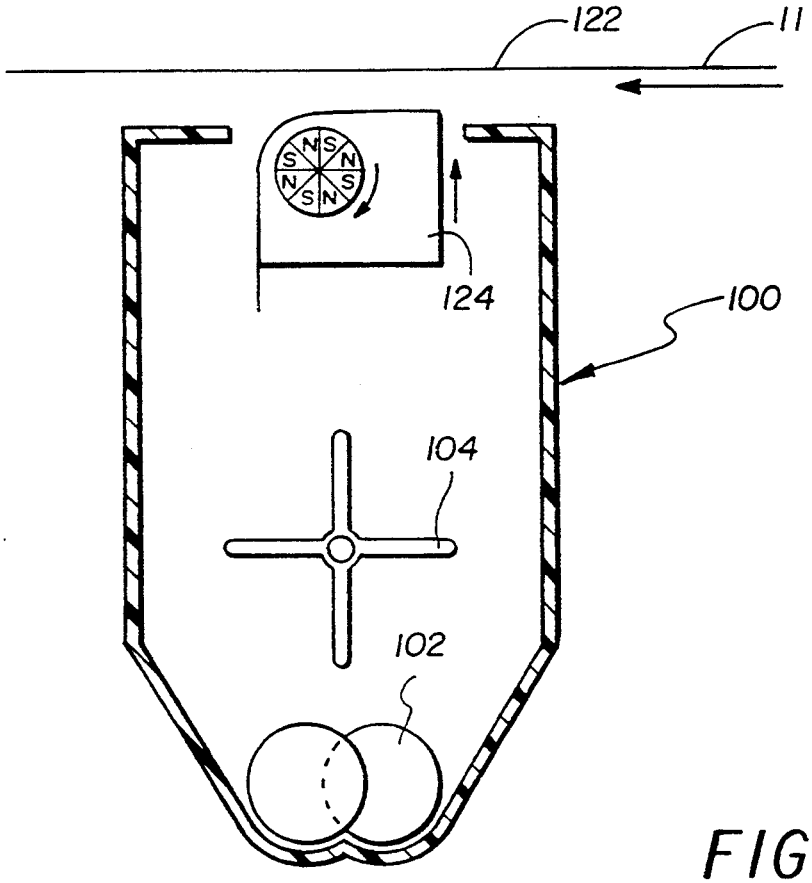

FIG. 2 shows a development station 100 of slightly different construction from that shown in FIG. 1. According to FIG. 2, toner is replenished by a replenishment system opposite an end of the toning station and not shown. The toning station itself includes cooperating paddle augers 102 and a mixing paddle 104 which cooperate to thoroughly mix the developer, providing a uniform toner concentration and appropriate charging. It also raises the level of developer to a position that it can be attracted by a rotating magnetic core 122 inside a stationary shell 124 constructed similar to that shown in FIG. 1. Note the somewhat more simple shape of shell 124 and the location of core 122 positioned to prevent loss of carrier as the developer leaves the development zone.

In both the FIG. 1 and 2 embodiments, the core is rotated rapidly, for example, more than 1000 revolutions per minute, to cause the magnetic carrier to flip rapidly as it is subjected to rapid pole transitions. This flipping causes the developer to move around the sleeve in a direction opposite to the core rotation, aided by a roughness to the sleeve.

Figure 3:
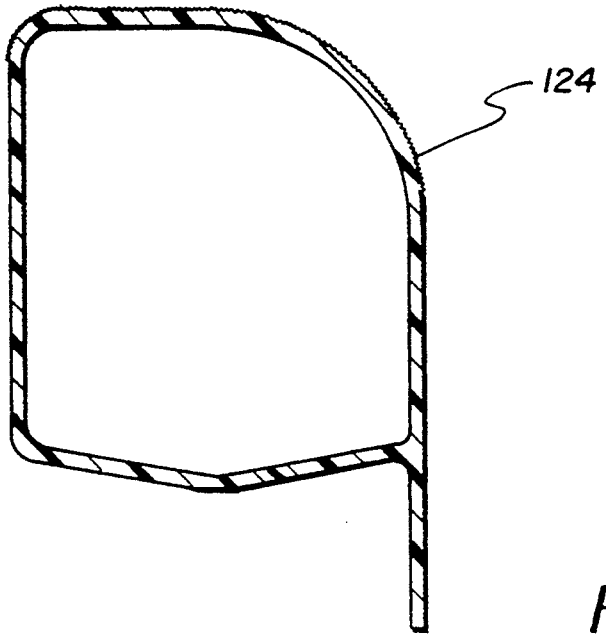
FIG. 3 is an enlarged rear section of a sleeve usable in the toning station shown in FIG. 2.

The shell 124 is shown in FIG. 3 in a size somewhat magnified from that of actual practice. Note that the upper portion of the shell has been serrated as part of an extrusion process forming the shell. Shell 36 in FIG. 1 is also similarly serrated, according to the invention, although not visible in the drawing. The serrations are sufficiently fine to contribute to the movement of the developer without trapping the finer particles of toner. For example, the serrations can be 0.01 inches in width and 0.004 inches in height, providing 100 serrations to the inch.

The serrations are formed by pressing aluminum through a suitable die in a conventional extrusion process with the die appropriately shaped to form the serrations.

With a shell manufactured as described, the roughening of the outside surface is extremely regular without any risk of localized loss of roughening to affect the reliability of toning, and the shell is not weakened, as is the case with other process, such as sandblasting. One process produces both the tube and the roughened surface.

The invention has been described in detail with particular reference to a preferred embodiment thereof, but it will be understood that variations and modifications can be effected within the spirit and scope of the invention as described hereinabove and as defined in the appended claims.

We claim:

1. A toning station for applying dry toner to an electrostatic image moving in a first direction through a development zone, said station comprising an elongated sleeve or shell having a long dimension oriented transverse to the first direction and having an outside surface, a magnetic core which is rotatable to tumble developer having a magnetic component on the outside surface, said outside surface being rough to cause the developer to move along the outside surface in response to rotation of the core, through the development zone and toning relation with the electrostatic image, characterized in that the outside surface contains fine, regular, extrusion-formed serrations extending the entire long dimension of the shell.

2. A toning station according to claim 1 wherein the serrations are approximately 0.01 inches across and 0.004 inches in height.

3. A toning station according to claim 1 wherein the sleeve or shell is a stationary shell having a noncircular cross-section which includes a substantially straight flat portion, and said station is positioned with respect to an image member carrying an electrostatic image such that said electrostatic image is in close proximity to the flat portion while in toning relation with developer moving across said flat portion.

* * * * *